US009276311B2

(12) United States Patent
Chow et al.

(10) Patent No.: US 9,276,311 B2
(45) Date of Patent: Mar. 1, 2016

(54) PANEL ANTENNA

(71) Applicant: HON HAI PRECISION INDUSTRY CO., LTD., New Taipei (TW)

(72) Inventors: John Chow, Saratoga, CA (US); Yun-Cheng Hou, New Taipei (TW); Chang-Ching Lin, New Taipei (TW); Sheng-Che Chang, New Taipei (TW); Chih-Hao Chang, New Taipei (TW); Chi-Hsuan Chang, New Taipei (TW)

(73) Assignee: HON HAI PRECISION INDUSTRY CO., LTD., New Taipei (TW)

( * ) Notice: Subject to any disclaimer, the term of this patent is extended or adjusted under 35 U.S.C. 154(b) by 302 days.

(21) Appl. No.: 13/919,157

(22) Filed: Jun. 17, 2013

(65) Prior Publication Data

US 2013/0335296 A1 Dec. 19, 2013

(30) Foreign Application Priority Data

Jun. 16, 2012 (CN) ..... 2012 1 0198303

(51) Int. Cl.
*H01Q 1/38* (2006.01)
*H01Q 9/42* (2006.01)
*H01Q 21/24* (2006.01)

(52) U.S. Cl.
CPC . *H01Q 1/38* (2013.01); *H01Q 9/42* (2013.01); *H01Q 21/24* (2013.01)

(58) Field of Classification Search
CPC ..... H01Q 1/38; H01Q 21/24; H01Q 9/42
See application file for complete search history.

(56) References Cited

U.S. PATENT DOCUMENTS

| | | | | |
|---|---|---|---|---|
| 6,008,774 | A | 12/1999 | Wu | |
| 6,734,826 | B1 * | 5/2004 | Dai et al. | 343/700 MS |
| 6,791,506 | B2 | 9/2004 | Suganthan et al. | |
| 6,917,333 | B2 * | 7/2005 | Ikegaya et al. | 343/700 MS |
| 6,943,734 | B2 | 9/2005 | Zinanti et al. | |

(Continued)

FOREIGN PATENT DOCUMENTS

| | | | |
|---|---|---|---|
| CN | 1362755 | A | 8/2002 |
| CN | 1787285 | A | 6/2006 |

(Continued)

*Primary Examiner* — Trinh Dinh
(74) *Attorney, Agent, or Firm* — Ming Chieh Chang; Wei Te Chung

(57) ABSTRACT

A panel antenna includes a panel portion and a feeder cable. The panel portion includes a first portion and a second portion connected with the first portion to form a L-shape. A first metal sheet is disposed on the first portion. A second metal sheet is disposed on the second portion. The first and second metal sheets connect with each other. The first metal sheet has a feeding point and the second metal sheet has an elongate connecting arm. The overall structure of the first and second metal sheets forms a L-shape The feeder cable includes an inner conductor electrically connecting with the feeding point and an outer conductor extending along the connecting arm. The outer conductor has an exposed part contacted with the connecting arm.

11 Claims, 3 Drawing Sheets

(56) References Cited

U.S. PATENT DOCUMENTS

| | | | | |
|---|---|---|---|---|
| 7,501,991 | B2 | 3/2009 | Yeap | |
| 8,421,681 | B2 | 4/2013 | Chiu et al. | |
| 8,432,317 | B2 | 4/2013 | Chen | |
| 8,502,747 | B2 * | 8/2013 | Chang et al. | 343/822 |
| 8,638,271 | B2 * | 1/2014 | Wang et al. | 343/846 |
| 2004/0056808 | A1 * | 3/2004 | Jenwatanavet | 343/702 |
| 2004/0178957 | A1 * | 9/2004 | Chang et al. | 343/700 MS |
| 2006/0082504 | A1 * | 4/2006 | Chen et al. | 343/700 MS |
| 2009/0195473 | A1 * | 8/2009 | Ke et al. | 343/846 |
| 2009/0231230 | A1 * | 9/2009 | Hung et al. | 343/848 |
| 2009/0284432 | A1 * | 11/2009 | Cozzolino et al. | 343/821 |
| 2011/0043432 | A1 * | 2/2011 | Ineichen et al. | 343/876 |
| 2011/0221938 | A1 * | 9/2011 | Leung et al. | 348/243 |

FOREIGN PATENT DOCUMENTS

| | | | |
|---|---|---|---|
| CN | 1816941 | A | 8/2006 |
| CN | 101888020 | A | 11/2010 |
| JP | 2005268851 | A | 9/2005 |
| JP | 201219310 | A | 1/2012 |
| TW | M257521 | U | 2/2005 |
| TW | M276333 | | 9/2005 |
| TW | I255581 | B | 5/2006 |
| TW | I331825 | | 10/2010 |

* cited by examiner

PANEL ANTENNA

BACKGROUND OF THE INVENTION

1. Field of the Invention

The present invention generally relates to a panel antenna used in an electronic device, and more particularly relates to a panel antenna that has a radiation pattern exhibiting good radiation dispersion characteristics.

2. Description of Related Art

A panel antenna is a conventional antenna. Prior art design shown in FIG. 1 discloses a panel antenna comprising a rectangular panel portion 1' and a coaxial feeder cable 2'. The panel portion 1' comprises a feeding point 10' and a grounding point 12'. The feeder cable 2' comprises a core 21' connected with the feeding point 10' and a braid layer 22' connected with the grounding point. A peak gain of the panel antenna can be high in a horizontal polarization or a vertical polarization so as not to meet requirements of wireless products.

Hence, an improved panel antenna is desired to overcome the above-mentioned shortcomings of existing planar antennas.

SUMMARY OF THE INVENTION

Accordingly, an object of the present invention is to provide a panel antenna having a simple structure and making a radiation intensity dispersed into a vertical polarization and a horizontal polarization.

In order to achieve the above-mentioned object, a panel antenna comprises a panel portion and a feeder cable. The panel portion comprises a first portion and a second portion connected with the first portion to form a L-shape. A first metal sheet is disposed on the first portion, and a second metal sheet is disposed on the second portion. The first and second metal sheets connect with each other. The first metal sheet has a feeding point and the second metal sheet has an elongate connecting arm, the overall structure of the first and second metal sheets forming a L-shape. The feeder cable comprises an inner conductor electrically connecting with the feeding point and an outer conductor extending along the connecting arm. The outer conductor includes an exposed part contacting with the connecting arm and having a length equal to a length of the connecting arm.

Other objects, advantages and novel features of the invention will become more apparent from the following detailed description when taken in conjunction with the accompanying drawings.

DETAILED DESCRIPTION OF THE PREFERRED EMBODIMENT

Figure 1:
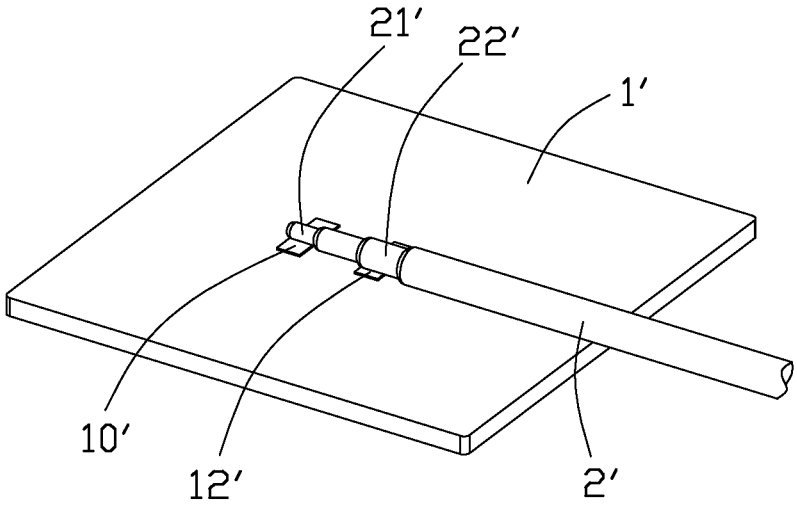
FIG. 1 (PRIOR ART)
FIG. 1 is an assembled perspective view showing a panel antenna of the prior art.

Reference will now be made to the drawing figures to describe the present invention in detail.

Figure 2:
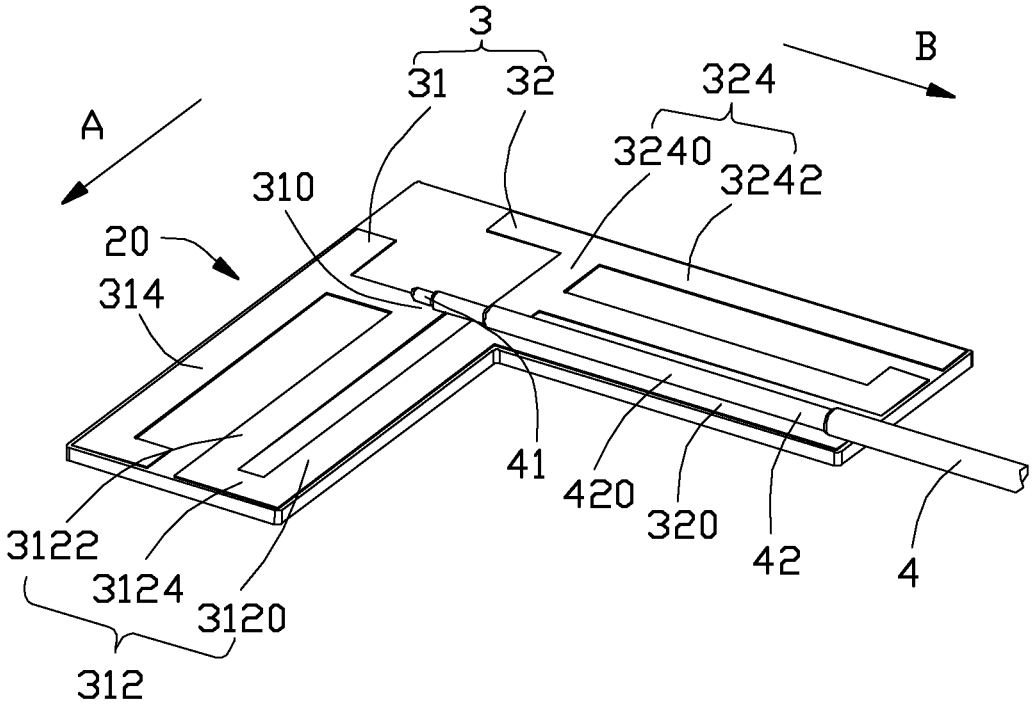
FIG. 2 is an assembled perspective view showing a panel antenna of the present invention.
Figure 3:
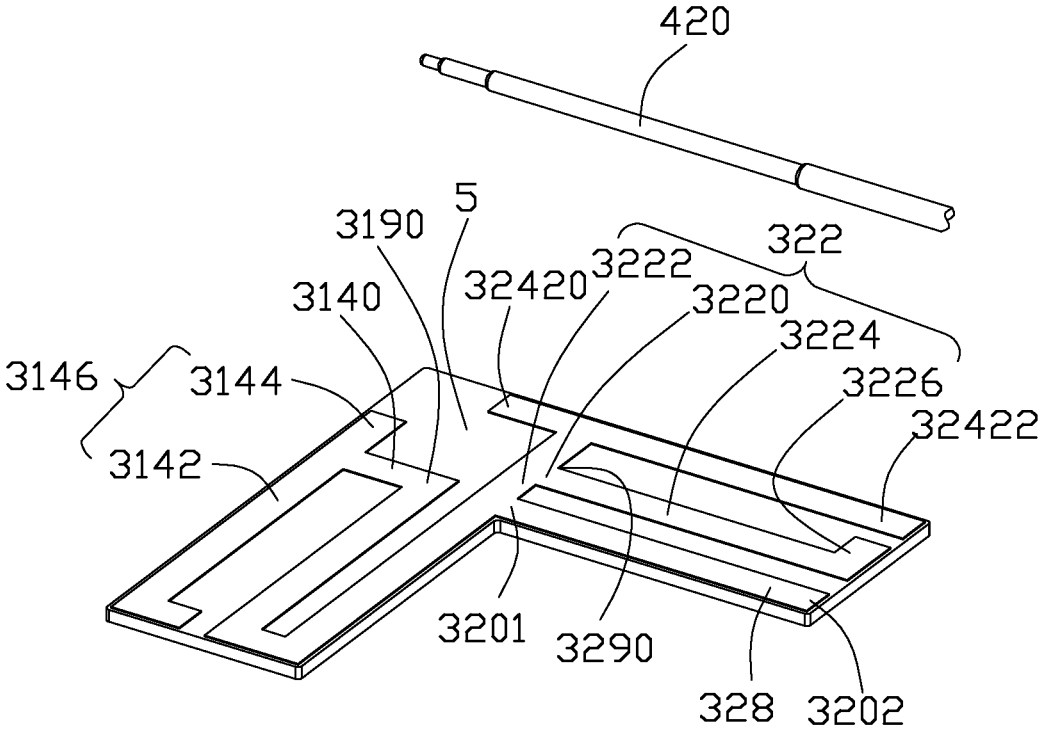
FIG. 3 is a partially expoded view of the panel antenna as shown in FIG. 2.

Referring to FIGS. 2 to 3, this description of preferred embodiments is intended to be read in connection with the accompanying drawings, which are to be considered part of the entire written description of this invention. In this description, a panel antenna 20 comprises a panel portion 3 and a feeder cable 4. The panel portion 3 comprises a first portion (not labeled) in a direction "A" and a second portion (not labeled) in a direction "B" connected with the first portion to form a L-shape. A first metal sheet 31 is disposed on the first portion, and a second metal sheet 32 is disposed on the second portion. The first and second metal sheets 31,32 connect with each other. The first metal sheet 31 has a feeding point 310 and the second metal sheet 32 has an elongate connecting arm 320. The overall structure of the first and second metal sheets 31,32 forms a L-shape. The feeder cable 4 comprises an inner conductor 41 electrically connecting with the feeding point 310 and an outer conductor 42 extending along the connecting arm 320. The outer conductor 42 includes an exposed part 420 having a length equal to a length of the connecting arm 320, and the exposed part 420 is in contact with the connecting arm 320 for the whole length.

The first metal sheet 31 includes a first metal wire 312 designed as a U-shape, and a second metal wire 314 designed as a T-shape extending from an end of the first metal wire 312. The first metal wire 312 includes a first side arm 3120 connected with the connecting arm 320, a second side arm 3122 parallel to the first side arm 3120, and a third side arm 3124 connected with the first side arm 3120 and the second side arm 3122. The second metal wire 314 includes a connecting portion 3140 extending perpendicular to the second side arm 3122, and an extending portion 3146 connected with the connecting portion 3140. The extending portion 3146 is divided into a fourth side arm 3142 and a fifth side arm 3144 by the connecting portion 3140. The fourth side arm 3142 is designed as a L-shape, and the fifth side arm 3144 extends along a straight wire. The extending portion 3146 is parallel to the second side arm 3122 of the first metal wire 312. The connecting portion 3140 is parallel to the third side arm 3124 of the first metal wire 312. An end of the fourth side arm 3142 extends toward the first metal wire 312. The feeding point 310 is located at a junction of the second side arm 3122 of the first metal wire 312 and the second metal wire 314.

The connecting arm 320 includes a first end 3201 connected with the first metal sheet 31 and a second end 3202 extending vertically from the first metal sheet 31. The second metal sheet 32 further includes a third metal wire 322 having a bending part 3220, and a fourth metal wire 324. The third metal wire 322 is designed as a Z-shape extending from the first end 3201 of the connecting arm 320, and the fourth metal wire 324 is designed as a T-shape extending from the bending part 3220 of the third metal wire 322. The third metal wire 322 includes a first side portion 3222 extending vertically from the connecting arm 320, a second side portion 3224 extending from the first side portion 3222 and parallel to the connecting arm 320, and a third side portion 3226 extending vertically from the second side portion 3224 and toward the fourth metal wire 324. The connecting arm 320 has a length equal to the length of the second side portion 3224. The fourth metal wire 324 includes a connecting wire 3240 extending from a junction of the first side portion 3222 and second side portion 3224 of the third metal wire 322, and an extending wire 3242 connected with the connecting wire 3240. The extending wire 3242 is divided into a first part 32420 and a second part 32422 by the connecting line 3240. The extending wire 3242, the second side portion 3224, and the connecting arm 320 are disposed parallel to each other. All of the first side portion 3222, the connecting wire 3240 of the fourth metal wire 324, and the first side arm 3120 of the first metal sheet 31 extend along a straight wire. Two straight wires are formed by side edges of the first side portion 3222, the connecting wire 3240 of the fourth metal wire 324, and the first side arm 3120 of the first metal sheet 31. The third side portion 3226 of the third metal wire 322 is parallel to the first side portion 3222.

Both the first metal sheet 31 and the second metal sheet 32 comprise first metal wires 312,328 designed as U-shape and second metal wires 314,324 designed as T-shape. The second metal wire 314 of the first metal sheet 31 has a first bottom portion 3190. The second metal wire 324 of the second metal sheet 32 has a second bottom portion 3290. The difference between the first metal sheet 31 and the second metal sheet 32 is that the first bottom portion 3190 of the first metal sheet 31 connects with an end of the second side arm 3122 of the first metal wire 312 while the second bottom portion 3290 of the second metal sheet 32 connects with an end of the first side portion 3222 of the second metal sheet 32. In this embodiment, the first metal sheet 31 and the second metal sheet 32 are fixed on an insulating base 5. The insulating base 5 is designed as a L-shape.

In the description, the structure of the panel antenna 20 is designed as a L-shape to engage with the feeder cable 4. This arrangement disperses the radiation polarization of the panel antenna 20 into the horizontal polarization and the vertical polarization. Due to the panel antenna 20 being usually vertically or horizontally installed in an electronic equipment, the panel antenna 20 has a good performance in either the horizontal polarization or the vertical polarization, but not both. It could lead to a peak gain too high on one of the two polarization directions. Therefore, it does not satisfy requirements of wireless products. In this invention, the panel antenna 20 is designed as a L-shape where the radiation intensity of the panel antenna 20 is dispersed into the horizontal polarization and the vertical polarization. The radiation intensity and the peak gain will not be too high on one polarization direction, nor the radiation intensity concentrated on one polarization.

It will be understood that the invention may be embodied in other specific forms without departing from the spirit or central characteristics thereof. The present examples and embodiments, therefore, are to be considered in all respects as illustrative and not restrictive, and the invention is not to be limited to the details given herein.

What is claimed is:

1. A panel antenna comprising:

a panel portion comprising a first portion and a second portion connected with each other to form a L-shape, a first metal sheet disposed on the first portion, and a second metal sheet disposed on the second portion, the first and second metal sheets connected with each other, the first metal sheet having a feeding point and the second metal sheet having an elongate connecting arm, the overall structure of the first and second metal sheets being L-shaped; and a feeder cable comprising an inner conductor electrically connecting with the feeding point and an outer conductor extending along the connecting arm, the outer conductor having an exposed part contacting with the connecting arm, wherein the first metal sheet comprises a first metal wire designed as a U-shape and a second metal wire designed as a T-shape extending from an end of the first metal sheet.

2. The panel antenna as claimed in claim 1, wherein the first metal wire comprises a first side arm, a second side arm parallel to the first side arm, and a third side arm connected with the first side arm and the second side arm, and wherein the second metal wire extends outwardly from an end of the second side arm.

3. The panel antenna as claimed in claim 2, wherein the feeding point is located at a junction of the second arm of the first metal wire and the second metal wire.

4. The panel antenna as claimed in claim 3, wherein the connecting arm has a first end connected with the first metal sheet and a second end extending perpendicular to the first metal sheet, and wherein the second metal sheet comprises a third metal wire designed as a Z-shape extending from the first end of the connecting arm and a fourth metal wire designed as a T-shape extending from a bending part of the third metal wire.

5. The panel antenna as claimed in claim 4, wherein the third metal wire comprises a first side portion extending vertically from the connecting arm, a second side portion extending from the first side portion and parallel to the connecting arm, and a third side portion towards the fourth metal wire and extending vertically from the second side portion, the connecting arm having a length equal to a length of the second side portion.

6. The panel antenna as claimed in claim 1, wherein the exposed part of the outer conductor has a length equal to a length of the connecting arm and is in contact with the connecting arm for the whole length.

7. An antenna comprising:

a rectangular board defining a large rectangular cutout to form an L-shaped configuration with a first part in a first direction and a second part in a second direction perpendicular to said first direction wherein said first part and said second part share a common corner portion opposite to said cutout diagonally;

a first metal sheet formed upon one face of said first part, facing toward an orthogonal direction perpendicular to both said first direction and said second direction;

a second metal sheet formed upon one face the second part, facing toward said orthogonal direction;

a feeder cable including an inner signal core mechanically and electrically connected to the first metal sheet, and an outer grounding core mechanically and electrically connected to the second metal sheet; wherein said feeder cable extends along an inner edge region of said second part proximal to said cutout.

8. The antenna as claimed in claim 7, wherein the first metal sheet includes an arm extending along the first direction and connected to the inner signal core and the second metal sheet includes a connecting arm extending in the second direction and connected to the outer grounding core.

9. The antenna as claimed in claim 8, wherein said first metal sheet further includes a portion extending at one end of said arm of the first metal sheet along said second direction and essentially aligned with the connecting arm in said second direction.

10. The antenna as claimed in claim 7, wherein said first metal sheet defines roughly a reverse S-shape while said second metal sheet defines roughly an E-shape.

11. The antenna as claimed in claim 7, wherein the first metal sheet and the second metal sheet commonly define a portion extending through a whole dimension of said L-shaped configuration in the first direction.

* * * * *